US006298813B1

(12) United States Patent
Asakura et al.

(10) Patent No.: US 6,298,813 B1
(45) Date of Patent: Oct. 9, 2001

(54) VARIABLE VALVE APPARATUS OF INTERNAL COMBUSTION ENGINE

(75) Inventors: Ken Asakura, Toyota; Kazuhisa Mikame, Nagoya; Toshiaki Hamaguri, Toyota, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/662,732

(22) Filed: Sep. 15, 2000

(30) Foreign Application Priority Data

Oct. 8, 1999 (JP) ..... 11-288121

(51) Int. Cl.[7] ..... F01L 13/00; F02D 13/02

(52) U.S. Cl. ..... 123/90.18; 123/90.17; 74/568 R

(58) Field of Search ..... 123/90.15, 90.17, 123/90.18, 90.31; 74/568 R

(56) References Cited

U.S. PATENT DOCUMENTS

| | | | | |
|---|---|---|---|---|
| 2,307,926 | | 1/1943 | Griffith et al. . | |
| 5,080,055 | | 1/1992 | Komatsu et al. | 123/90.17 |
| 5,893,345 | * | 4/1999 | Sugimoto et al. | 123/90.17 |
| 6,014,952 | * | 1/2000 | Sato et al. | 123/90.17 |
| 6,035,818 | * | 3/2000 | Sato et al. | 123/90.17 |
| 6,131,541 | * | 10/2000 | Hasegawa et al. | 123/90.18 |
| 6,170,448 | * | 1/2001 | Asakura | 123/90.18 |

FOREIGN PATENT DOCUMENTS

| | | |
|---|---|---|
| A1-44 10 034 | 9/1994 | (DE) . |
| A1-198 42 431 | 3/1999 | (DE) . |
| A1-0 590 577 | 4/1994 | (EP) . |
| 10-30413 | 2/1998 | (JP) . |
| 11-153009 | 6/1999 | (JP) . |
| 11-218014 | 8/1999 | (JP) . |

* cited by examiner

*Primary Examiner*—Weilun Lo
(74) *Attorney, Agent, or Firm*—Oliff & Berridge PLC

(57) ABSTRACT

A phase variation actuator has an outer rotor that is connected to a cam sprocket so that the outer rotor is rotatable together with the cam sprocket, and an inner rotor that is connected to a journal so that the inner rotor is rotatable together with the journal. The journal is rotatably supported by an internal combustion engine. A camshaft is inserted into a slide hole of the journal provided near the phase variation actuator so that the camshaft is slidable in the direction of the rotating axis of the camshaft. The camshaft is connected to the journal by meshing of splines so that the camshaft is rotatable together with the journal.

18 Claims, 7 Drawing Sheets

VARIABLE VALVE APPARATUS OF INTERNAL COMBUSTION ENGINE

INCORPORATION BY REFERENCE

The disclosure of Japanese Patent Application No. 11-288121 filed on Oct. 8, 1999, including the specification, drawings and abstract is incorporated herein by reference in its entirety.

BACKGROUND OF THE INVENTION

1. Field of the Invention

The invention relates to a variable valve apparatus of an internal combustion engine and, more particularly, to an internal combustion engine variable valve apparatus including a phase variation actuator that varies the rotation phase of a camshaft and a cam displacement actuator that displaces the camshaft in the direction of a rotating axis of the camshaft.

2. Description of Related Art

Phase variation type variable valve apparatus capable of varying the relative rotation phase between a camshaft and a crankshaft, that is, an engine output shaft, are conventionally known. Such a phase variation type variable valve apparatus has a first rotating body that is connected to a drive-transmission wheel for transmitting rotation from the crankshaft, such as a cam sprocket, a cam pulley, or the like, so that the first rotating body is rotatable together with the drive-transmission wheel, and a second rotating body that is connected to the camshaft so that the second rotating body is rotatable together with the camshaft. The variable valve apparatus further has a phase variation actuator for turning the first and second rotating bodies relative to each other through the use of, for example, a vane construction or a gear connecting construction having helical splines. Using the actuator, the variable valve apparatus varies the relative rotation phase between the crankshaft and the camshaft so as to vary the valve timing of the engine valves that are opened and closed by rotation of the camshaft.

Also known is a cam displacement type variable valve apparatus that displaces a camshaft in the direction of a rotating axis thereof, the camshaft being provided with three-dimensional cams whose cam profile shape varies in the direction of the rotating axis. In the cam displacement type variable valve apparatus, the camshaft is displaced in the direction of a rotating axis thereof to change the cam profile of each three-dimensional cam at the site of contact with the valve lifter of the corresponding engine valve, by using an actuator (cam displacement actuator) of, for example, a hydraulic drive type or the like, whereby the characteristic of the engine valves is changed.

Furthermore, a variable valve apparatus having both a phase variation actuator and a cam displacement actuator as described above is disclosed in Japanese Patent Application Laid-Open No. 11-153009. In such a variable valve apparatus, it is necessary to connect a camshaft to the phase variation actuator so that the camshaft is slidable in the direction of a rotating axis thereof, in order to allow the cam displacement actuator to displace the camshaft.

FIG. 9 shows a sectional structure of a phase variation actuator and its peripheral portion of a variable valve apparatus having a phase variation type valve variable mechanism and a three-dimensional cam type variable valve mechanism.

As shown in FIG. 9, a cam sprocket 113, a journal 114 and a phase variation actuator 119 are provided at a distal end portion of a camshaft 110 having a three-dimensional cam 111. The cam sprocket 113 is a drive-transmission wheel that is drivingly connected by a chain to a crankshaft, that is, an engine output shaft of an internal combustion engine. The cam sprocket 113 is rotatably supported to the engine by the journal 114. Rotation of the cam sprocket 113 is transmitted to the camshaft 110 via the phase variation actuator 119.

The phase variation actuator 119 has an outer rotor (first rotating body) 121 that is connected to the cam sprocket 113 so that the outer rotor 121 is rotatable together with the cam sprocket 113, and an inner rotor (second rotating body) 120 that is connected to the camshaft 110 so that the inner rotor 120 is rotatable together with the camshaft 110. The outer rotor 121 is disposed radially outwardly of the inner rotor 120 (relative to the rotation axis) so that the outer rotor 121 and the inner rotor 120 have one and the same rotating axis and are rotatable relatively to each other.

The phase variation actuator 119 as shown in FIG. 9 is a generally-termed vane type phase variation actuator. The phase variation actuator 119 turns the rotors 120, 121 relative to each other based on adjustment of pressure of oil introduced into liquid chambers 123 provided in slide-contact portions of the inner rotor 120 and the outer rotor 121. By changing the relative rotation phase between the cam sprocket 113 connected to the outer rotor 121 and the camshaft 110 connected to the inner rotor 120, the phase variation actuator 119 changes the valve timing of the engine valves, which are opened and closed based on rotation of the camshaft 110.

A distal end portion of the camshaft 110 is inserted into the inner rotor 120 of the phase variation actuator 119 so that the distal end portion is slidable along an inner peripheral portion of the inner rotor 120 in the direction of a rotating axis thereof. The inner periphery of the inner rotor 120 and the outer periphery of the camshaft 110 have splines 112, 117, respectively. Thus, the phase variation actuator 119 employs a connecting construction wherein via meshing of the splines 112, 117, the inner rotor 120 and the camshaft 110 are connected so that they are rotatable together and so that the camshaft 110 is allowed to be displaced in the direction of the rotating axis.

In the example shown in FIG. 9, the phase variation actuator 119 further has, inside thereof, a sub-gear 130 for preventing production of noises of tooth impacts between the splines 112, 117 that would otherwise be caused by torque fluctuations on the camshaft 110 involved in the opening and closing of the engine valves. The sub-gear 130 is disposed between the distal end portion of the camshaft 110 and the inner rotor 120.

An outer periphery of the sub-gear 130 has external splines 131 whose tooth trace extends in the direction of the rotating axis. An inner periphery of the sub-gear 130 has internal splines 132 whose tooth trace extends in a direction diagonal to the rotating axis. The sub-gear 130 is connected to the inner rotor 120 by meshing between the external splines 131 and the internal splines 117 formed in an inner periphery of the inner rotor 120. The sub-gear 130 is connected to the camshaft 110 by meshing between the internal splines 132 and external helical splines 118 provided in an outer periphery of a distal end portion of the camshaft 110.

The sub-gear 130 is urged in a direction of the rotating axis by an urging member 133, such as a wave washer (a washer having undulations) or the like. Via the helical-splines 118, 132, the sub-gear 130 converts the force from the urging member 133 into forces in rotating directions, thereby urging the inner rotor 120 and the camshaft 110 in such directions as to turn relative to each other. In this manner, the sub-gear 130 eliminates backlashes between the splines 112, 117, thereby substantially preventing noises of impacts between spline teeth.

Thus, since the camshaft 110 and the inner rotor 120 of the phase variation actuator 119 are connected by meshing between the splines 112, 117 extending in the direction of the rotating axis thereof, the camshaft 110 is allowed to be displaced in the direction of the rotating axis while the camshaft 110 and the inner rotor 120 are integrally rotatably connected.

However, if this connecting construction is adopted, there is a possibility that the phase variation actuator 119 may have an increased diameter because the camshaft 110 needs to be inserted into the phase variation actuator 119 and the splines 112, 117 need to be formed for connection between the camshaft 110 and the phase variation actuator 119. In the case of the vane-type phase variation actuator as mentioned above, in particular, an increased diameter of the phase variation actuator 119 is inevitable because the liquid chambers 123 having sufficient capacities are formed radially outwardly of the inner rotor 120, into which the camshaft 110 is inserted.

Furthermore, if a construction using the sub-gear 130 for preventing spline impact noises as described above is adopted, the need to dispose the sub-gear 130 and the like within the phase variation actuator 119 further increases the diameter of the phase variation actuator 119.

Thus, according to the conventional art, if a camshaft is connected to a phase variation actuator so that the camshaft is allowed to be displaced, the phase variation actuator 119 inevitably has an increased diameter, so that drawbacks, such as a degraded installability, an increased weight, and the like, result.

SUMMARY OF THE INVENTION

Accordingly, it is an object of the invention to provide a variable valve apparatus of an internal combustion engine that is capable of favorably curbing an increase in the diameter of a phase variation actuator even if a camshaft is connected to the actuator so that the camshaft is allowed to be displaced in a direction of a rotating axis thereof.

A variable valve apparatus of an internal combustion engine in accordance with a first aspect of the invention includes a first rotating body for connection to a drive-transmission wheel that transmits rotation of an engine output shaft, in such a manner that the first rotating body is rotatable together with the drive-transmission wheel. The apparatus also includes a second rotating body which has a rotating axis in common with the first rotating body, and which is rotatable relative to the first rotating body. The apparatus also includes a phase variation actuator that turns the first rotating body and the second rotating body relative to each other, a journal which is provided near the phase variation actuator, and which is connected to the second rotating body so that the journal is rotatable together with the second rotating body, and which is rotatably supported by the internal combustion engine. Additionally, a slide hole portion is provided in the journal, and receives therein a camshaft of the internal combustion engine so that the camshaft is slidable in a direction of a rotating axis of the camshaft. An internal spline is formed in an inner periphery of the slide hole portion and extends in the direction of the rotating axis, and an external spline is formed in an outer periphery of the camshaft and meshes with the internal spline.

In this construction, the journal and the camshaft are connected for integral rotations via meshing between the internal spline formed in the inner periphery of the slide hole portion provided within the journal rotatably supported by the internal combustion engine, and the external spline formed in the outer periphery of the camshaft. The internal and external splines extend in the direction of the rotating axis of the camshaft, so that the camshaft is displaceable relative to the journal in the direction of the rotating axis thereof.

The journal, which is connected to the camshaft so as to be rotatable together with the camshaft while allowing the camshaft to be displaced in the direction of the rotating axis, is connected to the second rotating body of the phase variation actuator provided near the journal in such a manner that the journal is rotatable together with the second rotating body. Therefore, the relative rotation phase between the drive-transmission wheel and the camshaft can be changed by the phase variation actuator turning the first rotating body, which is connected integrally rotatably with the drive-transmission wheel for transmitting rotation from the engine output shaft of the internal combustion engine, and the second rotating body, which is connected integrally rotatably with the camshaft via the journal, relative to each other.

In this construction, the phase variation actuator and the camshaft are connected via the journal provided outside the actuator. Therefore, it becomes unnecessary to provide, within the phase variation actuator, a slide hole for receiving the camshaft in a slidable manner or splines for connecting the camshaft. Therefore, the above-described construction favorably avoids a diameter increase of the phase variation actuator that is conventionally caused by connecting the camshaft to the actuator while allowing the camshaft to be displaced in the direction of the rotating axis. As a result, the construction reduces installability deterioration and weight increase.

In the first aspect of the invention, one of the first rotating body and the second rotating body may be disposed radially outwardly of another one of the first rotating body and the second rotating body, and a space defined in a slide-contact portion between the first rotating body and the second rotating body by one of the first rotating body and the second rotating body may be divided into two liquid chambers by a vane which is formed in another one of the first rotating body and the second rotating body, and which extends in a direction of a radius of the rotating body. Based on an adjustment of a liquid pressure in the liquid chambers, the phase variation actuator may turn the first rotating body and the second rotating body relative to each other.

In this construction, the phase variation actuator employed is a generally-termed vane-type phase variation actuator that turns the first and second rotating bodies based on the adjustment of the liquid pressure in the liquid chambers separated by the vane.

In general, a vane-type phase variation actuator tends to have an increased diameter due to the need to form sufficiently large-capacity liquid chambers in slide-contact portions of the first and second rotating bodies. Therefore, if a camshaft is connected to an internal portion of the vane-type phase variation actuator so that the camshaft is allowed to be displaced in the direction of the rotating axis, the actuator will inevitably have an increased diameter.

In the above-described construction, however, the camshaft is connected to the phase variation actuator via the journal provided outside the actuator so as to avoid a further increase in the diameter of the phase variation actuator.

Therefore, even in the case of a vane-type phase variation actuator, it is possible to connect a camshaft to the actuator so that the camshaft is displaceable in the direction of the rotating axis and, at the same time, favorably avoid deterioration in the installability and an increase in the weight.

Furthermore, in the above-described aspect, a sub-gear for preventing production of a noise of an impact of the external spline and the internal spline, and an urging member that urges the sub-gear in the direction of the rotating axis may be provided within the journal.

If the camshaft and the journal are connected via meshing of splines as described above, an impact noise may be caused by a backlash between splines upon a torque change on the camshaft involved in the opening or closure of an engine valve. In some cases, therefore, the spline coupling portion is provided with an impact noise preventing construction employing a sub-gear and an urging member that urges the sub-gear in the direction of the rotating axis.

For example, the sub-gear is spline-coupled to the journal and to the camshaft, with the tooth traces of the splines differing in direction, more specifically, in the tilt angle, with respect to the direction of the rotating axis. Therefore, if the sub-gear is urged in the direction of the rotating axis by the urging member, the journal and the camshaft can be urged so as to turn relative to each other due to the different tilt angles of the tooth traces of the splines. In this manner, backlashes in the spline coupling portions of the journal and the camshaft are eliminated, so that production of impact noises by the splines can be controlled.

In the above-described construction, the urging member and the sub-gear for preventing impact noises are disposed within the journal, which is provided outside the phase variation actuator. Therefore, it is possible to provide the urging member and the sub-gear for preventing impact noises while favorably avoiding an increase in the diameter of the phase variation actuator.

In the above-described aspect of the invention, a cam displacement actuator that displaces the camshaft in the direction of the rotating axis of the camshaft may be provided, and one of operating directions of the cam displacement actuator in which a degree of a requirement in securing a response speed is higher may be set opposite to an urging direction of the urging member.

If the sub-gear and the urging member for preventing impact noises are provided as described above, a thrust force on the camshaft also acts on the sub-gear, and increases or decreases the sliding resistance involved in displacement of the camshaft.

For example, when the camshaft is displaced in the urging direction of the urging member, the force that acts on the sub-gear in the urging direction increases by the amount of thrust force transmitted thereto from the camshaft. Conversely, when the camshaft is displaced in the direction opposite to the urging direction, the force that acts on the sub-gear in the urging direction decreases by the amount of thrust force transmitted thereto. Therefore, when the camshaft is displaced in the urging direction of the urging member, the sliding resistance involved in the displacement becomes greater and securing of a response speed becomes more difficult than when the camshaft is displaced in the opposite direction.

Therefore, the controllability of the cam displacement actuator for displacing the camshaft in the direction of the rotating axis can be improved by a setting based on an association between the operating directions of the actuator and the urging direction of the urging member. That is, if one of the operating directions of the cam displacement actuator in which the requirement for the response speed is higher is set opposite to the urging direction of the urging member, a needed response speed can easily be secured. Therefore, the above-described construction makes it possible to secure a controllability of the cam displacement actuator in a more preferable fashion.

In the above-described aspect, the slide hole portion of the journal may have a support portion that supports the camshaft.

With this construction, the camshaft is supported to the journal via the support portion provided in the slide hole portion. As a result, it becomes possible to curb wobble and tilt of the rotating axis of the camshaft and the journal. If the rotating axis should wobble or tilt, the support portion bears a portion of the load, and therefore reduces the inappropriate load that acts on the external and internal splines. Therefore, it becomes possible to favorably curb the deterioration of the durability of the splines and the increase in the sliding resistance occurring during cam displacement.

Furthermore, in the above-described aspect, the support portion may be provided on an end side of the slide hole portion of the journal in the direction of the rotating axis, and the internal spline is provided on another end side of the slide hole portion in the direction of the rotating axis.

Therefore, the camshaft is supported by the internal spline provided in one end side portion of the journal and the support portion provided in an opposite end side portion of the journal, within the slide hole portion of the journal. Supporting the camshaft at the opposite end sides of the journal in this manner curbs wobble and tilt of the rotating axis of the journal. Therefore, the camshaft and the journal can be more stably connected, and therefore deterioration of the durability of the camshaft and the journal and increases in the sliding resistance occurring during cam displacement can be more effectively curbed.

Still further, in the above-described aspect, the support portion may be provided so as to support a portion of the camshaft that is located at a distal end side of the external spline of the camshaft.

In this construction, a portion of the camshaft located toward the distal end thereof from the internal spline is supported in the slide hole portion of the journal, so that the spline coupling portion formed by the external and internal splines can be supported at both sides thereof. Therefore, wobble and tilt of the rotating axis of the camshaft and the journal can be more effectively curbed. Furthermore, the inappropriate load that acts on the spline coupling portion due to wobble or tilt of the rotating axis can be more effectively reduced. As a result, deterioration of the durability of the splines and increases in the sliding resistance occurring during cam displacement can be more effectively curbed.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF PREFERRED EMBODIMENTS (First Embodiment)

A first embodiment that embodies the variable valve apparatus of an internal combustion engine of the invention will be described hereinafter in detail with reference to the drawings.

Figure 1:
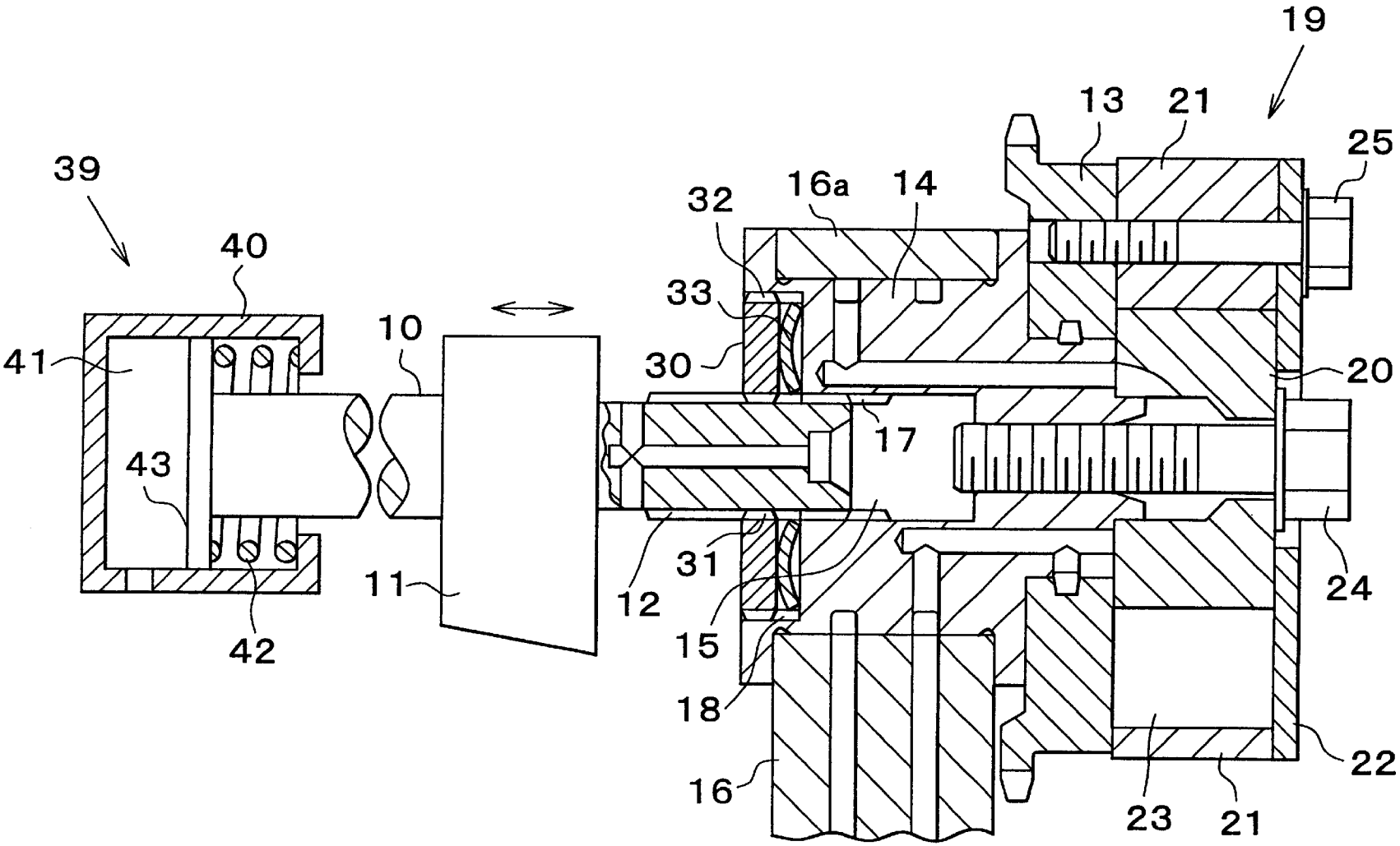
FIG. 1 is a sectional view showing sectional constructions of an actuator and a camshaft in a first embodiment of the invention.

FIG. 1 shows sectional constructions of a camshaft and its adjacent portions of a variable valve apparatus of an internal combustion engine according to the invention.

As shown in FIG. 1, a camshaft 10 has a three-dimensional cam 11 whose cam profile shape varies in a direction of a rotating axis of the camshaft 10. An engine valve (an intake or exhaust valve) of the internal combustion engine is urged in a valve opening direction by a valve spring, so that the engine valve is pressed against the three-dimensional cam 11. Thus, the engine valve is opened and closed by rotation of the camshaft 10.

A journal 14, a cam sprocket 13 and a phase variation actuator 19 are provided at one end side of the camshaft 10. Provided at another end side of the camshaft 10 is a cam displacement actuator 39 for displacing the camshaft 10 in the direction of the rotating axis thereof. Hereinafter, the end of the camshaft 10 where the cam sprocket 13, the phase variation actuator 19 and the like are provided will be referred to as "forward end", and the end of the camshaft 10 where the cam displacement actuator 39 is provided will be referred to as "rearward end".

The cam displacement actuator 39, provided at the rearward end side of the camshaft 10, has a hydraulic cylinder 40 for displacing the camshaft 10 in the direction of the rotating axis. Inside the cylinder 40, a piston 43 secured to the camshaft 10 is disposed displaceably in the direction of the rotating axis. Inside the cylinder 40, the piston 43 defines a liquid chamber 41 into which oil for engine lubrication is introduced.

The piston 43 is urged by a coil spring 42 disposed on a side opposite to the liquid chamber 41. In accordance with the balance between the urging force from the coil spring 42 and the pressure of oil in the liquid chamber 41, the piston 43 is moved within the cylinder 40 and is displaced in the direction of the rotating axis of the camshaft 10. Therefore, by adjusting the oil pressure in the liquid chamber 41, the camshaft 10 can be displaced in the direction of the rotating axis thereof. Hence, the cam profile of the three-dimensional cam 11 at the site of contact with the engine valve can be changed by displacing the camshaft 10, so that the valve characteristic of the engine valve can be changed.

The journal 14, provided at the forward end side of the camshaft 10, is rotatably supported to a cylinder head 16 of the engine by a journal cover 16*a*. The journal 14 has a slide hole 15 into which a forward end portion of the camshaft 10 is inserted slidably in the direction of the rotating axis of the camshaft 10. An outer periphery of a forward end portion of the camshaft 10 has external splines 12 extending in the direction of the rotating axis of the camshaft 10. The slide hole 15, into which the forward end portion of the camshaft 10 is inserted, also has, on its inner periphery, internal splines 17 extending in the direction of the rotating axis. Via the external and internal splines 12, 17, the camshaft 10 and the journal 14 are connected so that they are integrally rotatable and so that the camshaft 10 is allowed to be slid in the direction of the rotating axis.

At the forward end side of the journal 14, the cam sprocket 13 is mounted so that the cam sprocket 13 is turnable relative to the journal 14. That is the cam sprocket 13 can rotate about the rotating axis relative to the journal 14. The cam sprocket 13 is drivingly connected to a crankshaft, that is, an engine output shaft, by a chain (not shown), so as to transmit rotation to the journal 14 and the camshaft 10 via the phase variation actuator 19.

The phase variation actuator 19 is a hydraulic drive type actuator that turns the journal 14 and the cam sprocket 13 relative to each other and thereby varies the relative rotation phase of the camshaft 10 to the crankshaft.

The phase variation actuator 19 will next be described with reference to FIGS. 1 and 2.

The phase variation actuator 19 has an outer rotor 21 (first rotating body) that is connected to the cam sprocket 13 so that the outer rotor 21 is rotatable together with the cam sprocket 13, and an inner rotor 20 (second rotating body) that is connected to the camshaft 10 so that the inner rotor 20 is rotatable together with the camshaft 10. The outer rotor 21 is connected by a mounting bolt 25 to the cam sprocket 13 and to a cover 22 that covers a forward end side of the phase variation actuator 19, in such a manner that the outer rotor 21 is rotatable integrally with the cam sprocket 13 and the cover 22. The inner rotor 20 is connected to the journal 14 by a center bolt 24 for rotation together with the journal 14.

Figure 2:
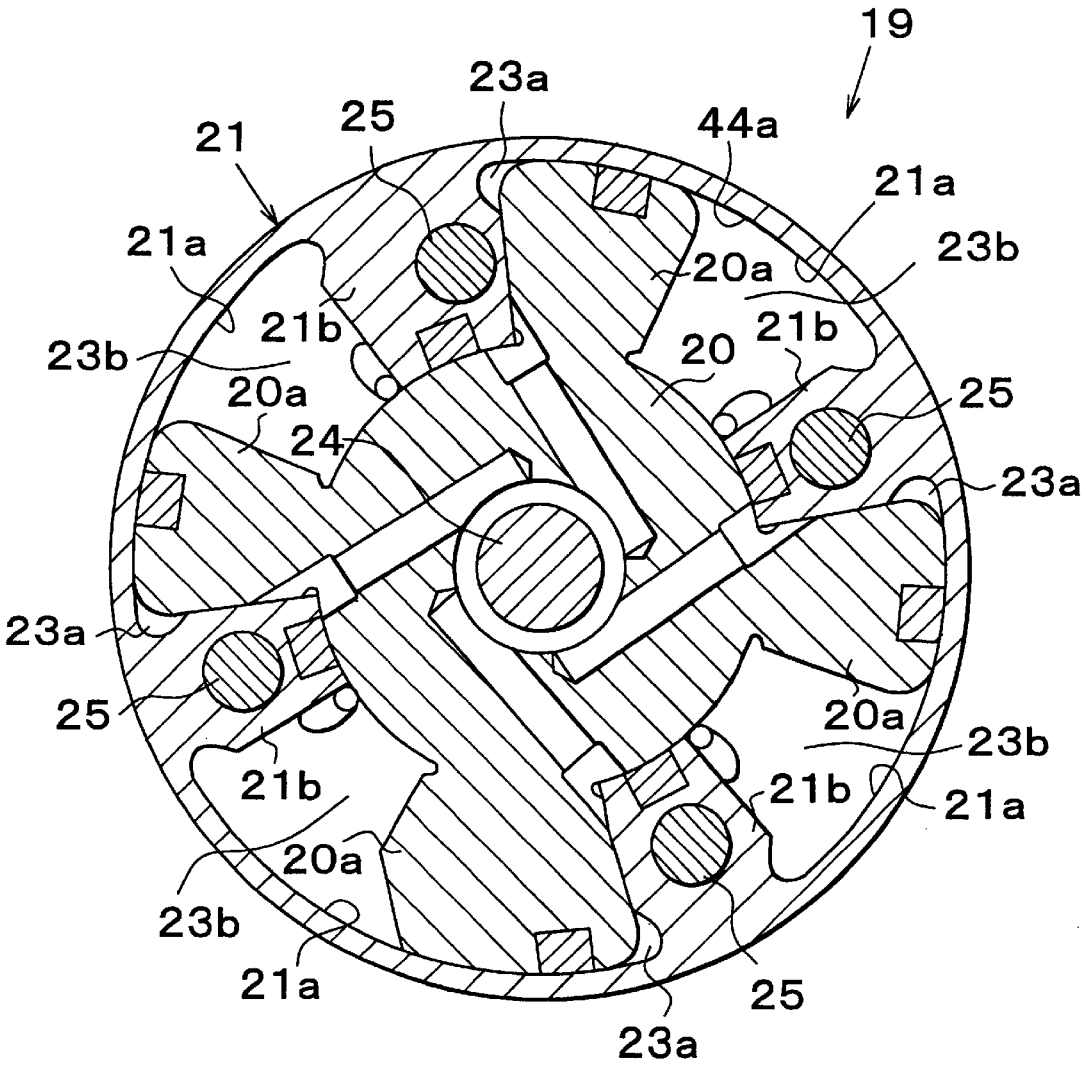
FIG. 2 is a sectional view showing a front sectional construction of a phase variation actuator in the first embodiment.

FIG. 2 shows a front sectional construction of the phase variation actuator 19.

As shown in FIG. 2, the inner rotor 20 has a plurality of radially extending vanes 20*a* (four vanes in FIG. 2). The outer rotor 21 has a generally circular ring shape. The outer rotor 21 has, in its inner periphery 44*a*, circumferentially extending recesses 21*a*. The number of the recesses 21*a* equals the number of the vanes 20*a*. Distal ends of protrusions 21*b* of the outer rotor 21 defining the recesses 21*a* are in sliding contact with outer peripheral surfaces of the inner rotor 20. The distal ends of the vanes 20*a* of the inner rotor 20 are in sliding contact with inner peripheral surfaces of the recesses 21*a* of the outer rotor 21. Therefore, the inner rotor 20 and the outer rotor 21 have a rotating axis in common, and are turnable (rotatable) relative to each other.

The space in each recesses 21*a* of the outer rotor 21 is divided into two liquid chambers 23 (23*a*, 23*b*) by the corresponding vane 20*a* of the inner rotor 20. The engine lubrication oil pressurized by an oil pump (not shown) is introduced into the liquid chambers 23. Rotation of the outer rotor 21 is transmitted to the vanes 20*a* of the inner rotor 20 via oil present in the liquid chambers 23. Therefore, rotation transmitted from the crankshaft of the engine to the cam sprocket 13 (see FIG. 1) is transmitted to the journal 14 and the camshaft 10 connected to the journal 14 for rotation together with the journal 14, via the phase variation actuator 19.

The oil pressure in the liquid chambers 23*a*, 23*b* on opposite sides of each vane 20*a* can be adjusted by supplying oil to and discharging oil from the liquid chambers 23*a*, 23*b* via oil passages (see FIG. 1) formed in the cylinder head 16, the journal 14, the cam sprocket 13, and the like. In accordance with the balance between the oil pressures acting on the opposite sides of each vane 20*a*, the inner rotor 20 is turned relative to the outer rotor 21. Therefore, through adjustment of the oil pressure in the liquid chambers 23*a*, 23*b*, the journal 14 connected to the inner rotor 20 for rotation together with the inner rotor 20 is turned relatively to the camshaft 10 and the cam sprocket 13 connected to the outer rotor 21 for rotation together with the outer rotor 21. Hence, the relative rotation phase of the camshaft 10 to the crankshaft can be varied, so that the valve timing of the engine valve opened and closed by rotation of the camshaft 10 can be varied.

In this embodiment, via meshing between the internal splines 17 formed on the inner periphery of the slide hole 15 formed in the journal 14 and the external splines 12 formed on the outer periphery of the forward end portion of the camshaft 10, the journal 14 and the camshaft 10 are connected so that they are integrally rotatable and so that the camshaft 10 is allowed to be displaced in the direction of the rotating axis thereof, as described above. The adoption of this connecting construction makes it possible to change the rotation phase of the camshaft 10 via the phase variation actuator 19 and to displace the cam via the cam displacement actuator 39.

Furthermore, in this embodiment, the connecting construction is provided in the journal 14 disposed outside the phase variation actuator 19. That is, it becomes unnecessary to provide the slide hole 15 or the splines 12, 17 inside the phase variation actuator 19. Hence, it becomes possible to connect the camshaft 10 to the phase variation actuator 19 so as to allow the camshaft 10 to be displaced in the direction of the rotating axis while favorably avoiding a substantial increase in the diameter of the phase variation actuator 19.

However, if the connecting construction based on the mesh of the splines 12, 17 is adopted, it becomes impossible to fit the splines 12, 17 very tightly to each other because the camshaft 10 needs to be slid. Therefore, there is a possibility that due to torque fluctuations that the camshaft 10 receives, noises of impacts between teeth of the splines 12, 17 due to backlashes may be produced. Hence, in this embodiment, an impact noise preventing construction for curbing noises of impacts between the splines 12, 17 caused by torque fluctuations is provided within the journal 14.

The impact noise preventing construction will next be described in detail with reference to FIGS. 1, 3 and 4.

The impact noise preventing construction is substantially made up of a sub-gear 30 that is spline-coupled to the camshaft 10 and to the journal 14, and a wave washer 33 that is an urging member for urging the sub-gear 30 in a direction of the rotating axis of the camshaft 10. The sub-gear 30 and the wave washer 33 are housed in a rearward end-side portion of the journal 14 as shown in FIG. 1.

Figure 3:
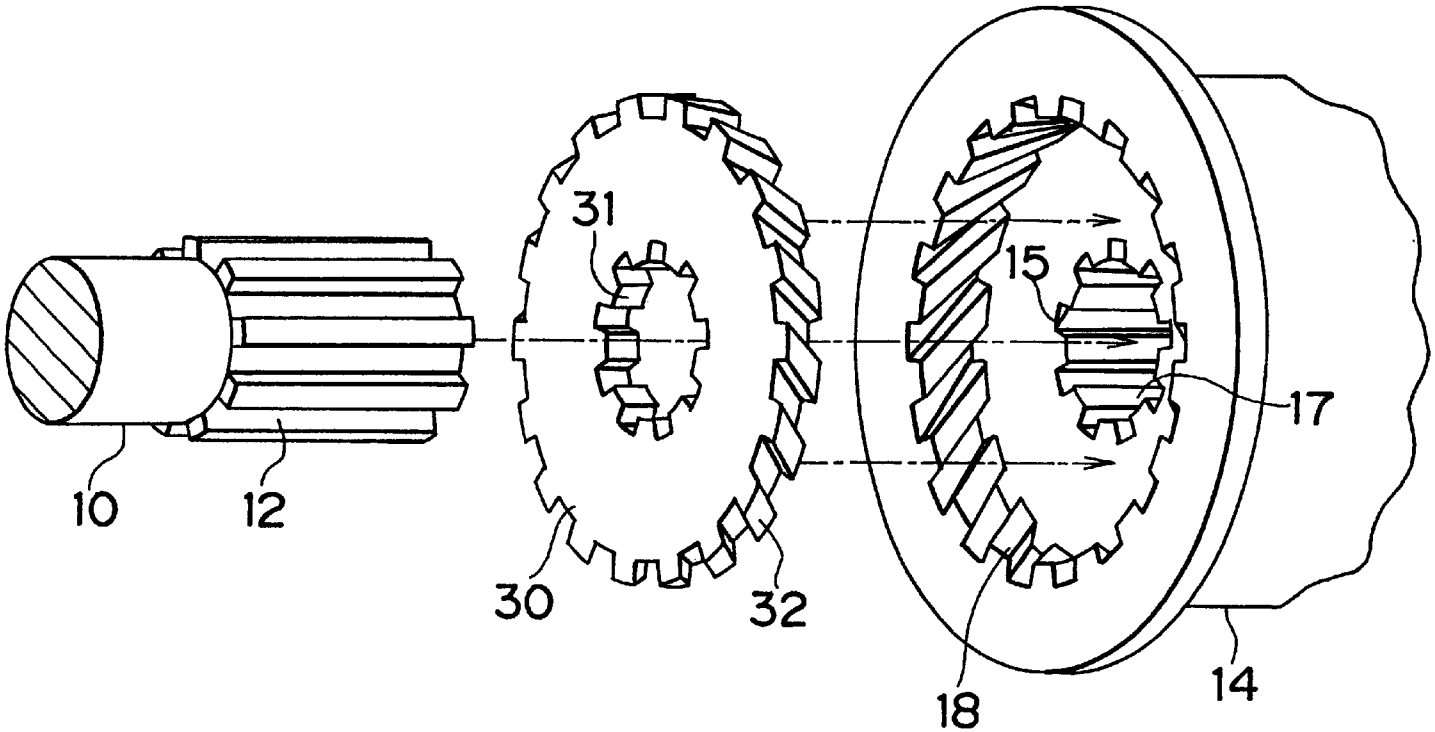
FIG. 3 is a perspective view of an impact noise preventing construction related to the phase variation actuator.

FIG. 3 shows perspective-view constructions of the camshaft 10, the journal 14 and the sub-gear 30. As shown in FIG. 3, the sub-gear 30 is a disc-shaped gear that has in its central portion a hole for insertion of the camshaft 10. An inner periphery of the hole has internal splines 31 that mesh with the external splines 12 of the camshaft 10. An outer periphery of the sub-gear 30 has external helical splines 32 extending in a direction oblique to the rotating axis. The external helical splines 32 mesh with internal helical splines 18 of the journal 14. Via the spline couplings, the sub-gear 30 is connected to the camshaft 10 and to the journal 14.

Furthermore, as shown in FIG. 1, the wave washer 33 is disposed between a rearward end surface of the journal 14 and a forward end surface of the sub-gear 30. Due to the force from the wave washer 33, the sub-gear 30 is constantly urged toward the rearward end of the camshaft 10. The force from the wave washer 33 is converted into forces in rotating directions via the helical spline coupling between the sub-gear 30 and the journal 14, thereby urging the journal 14 and the sub-gear 30 in such directions that the journal 14 and the sub-gear 30 are turned relative to each other about the rotating axis.

Figure 4:
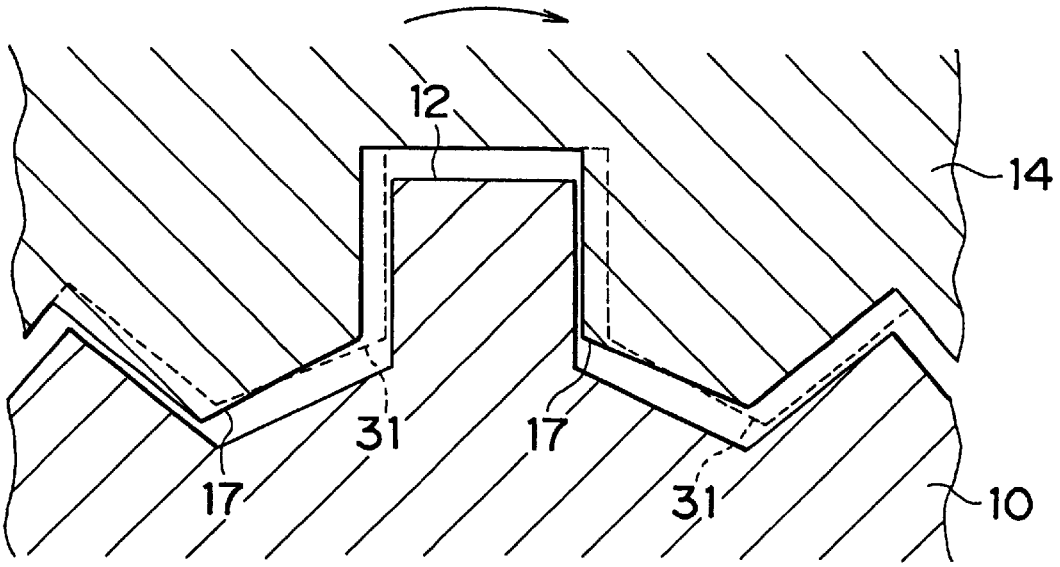
FIG. 4 is a sectional view showing a sectional construction of spline coupling portions of the phase variation actuator.

Therefore, as shown in FIG. 4, the tooth trace of the internal splines 17 of the journal 14 and the tooth trace of the internal splines 31 of the sub-gear 30 shift from each other in rotating directions, so that the internal splines 17 and the internal splines 31 constantly contact and press opposite sides of the corresponding ones of the external splines 12 of the forward end portion of the camshaft 10. That is, the rotating direction-facing side of each internal spline 17 of the journal 14 contacts and presses one side of the corresponding external spline 12 of the camshaft 10, and the rotating direction-facing side of each internal spline 31 of the sub-gear 30 contacts and presses the other side of the corresponding external spline 12. Therefore, the backlashes caused by torque fluctuations of the camshaft 10 are eliminated, so that noises of impacts between the spline teeth 12, 17 of the camshaft 10 and the journal 14 are controlled.

The internal combustion engine variable valve apparatus of this embodiment achieves the following advantages.

In this embodiment, the journal 14 rotatably supported to the cylinder head 16 of the internal combustion engine is connected to the inner rotor 20 of the phase variation actuator 19 for rotation together with inner rotor 20. The camshaft 10 is connected to an inner portion of the journal 14 via the spline coupling so that the camshaft 10 is rotatable integrally with the journal 14 and so that the camshaft 10 is allowed to be slid in the direction of the rotating axis. Due to the connection of the camshaft 10 to the journal 14, which is disposed outside the phase variation actuator 19, it is possible to favorably avoid an increase in the diameter of the phase variation actuator 19 and to curb deterioration in installability and an increase in weight.

In this embodiment, the construction for connection between the journal 14 and the camshaft 10 is applied to a variable valve apparatus employing the vane-type phase variation actuator 19, whose outer diameter tends to become large due to the need to provide liquid chambers 23*a*, 23*b* having sufficient capacity in slide-contact portions of the inner rotor 20 and the outer rotor 21. Therefore, even in the case of the vane-type phase variation actuator, it is possible to connect the camshaft to the actuator so as to be displaceable in the direction of the rotating axis while favorably curbing deterioration in installability and increases in weight.

In this embodiment, the sub-gear 30 for preventing noises of impacts in the spline-coupled portions and the wave washer 33 for urging the sub-gear 30 are also disposed inside the journal 14. Therefore, it is possible to provide the sub-gear 30 for preventing noises of impacts in the spline-coupled portions and the wave washer 33 for urging the sub-gear 30 without causing a diameter increase or a weight increase.

In this embodiment, all the constructions for connecting the camshaft 10 while allowing the camshaft 10 to be displaced in the direction of the rotating axis of the camshaft 10 are provided in the journal 14, which is disposed outside the phase variation actuator 19. Therefore, the connection of the camshaft 10 to the phase variation actuator 19 can be accomplished without a need to provide a special construction in the phase variation actuator 19. Hence, it is possible to use an existing phase variation actuator, that is, a phase variation actuator that is designed without taking the cam displacement into consideration.

In this embodiment, since the journal 14 is integrally rotatably connected to the camshaft 10, the journal 14 and the cam sprocket 13 are provided as separate members. Therefore, the journal 14 and the cam sprocket 13 may be formed from different materials. For example, with regard to the journal 14, which is turned and slid on the cylinder head 16 at high speed, it is not preferable to use a material having holes, such as a sintered material or the like, because such a material increases the friction with the contact member. With regard to the material of the cam sprocket 13, it is preferable to use a sintered material in view of the ease of forming and processing. Thus, even if the requirements for the cam sprocket 13 and the journal 14 are different, it is possible to use suitable materials separately for the journal 14 and the cam sprocket 13 since the journal 14 and the cam sprocket 13 are separate members, (Second Embodiment)

A second embodiment that embodies the variable valve apparatus of an internal combustion engine of the invention will be described mainly with regard to features that distinguish the second embodiment from the first embodiment.

If an impact noise preventing construction, such as the above-described sub-gear 30 urged in the direction of the rotating axis of the camshaft 10 or the like, is adopted, the pressing loads of the splines 12, 17, 31 on one another increase, so that the resistance to sliding in the direction of the rotating axis of the camshaft 10 increases to some extent. However, the extent of increase of the sliding resistance caused by the sub-gear 30 at the time of cam displacement varies depending on the sliding direction of the camshaft 10.

Figure 5A:
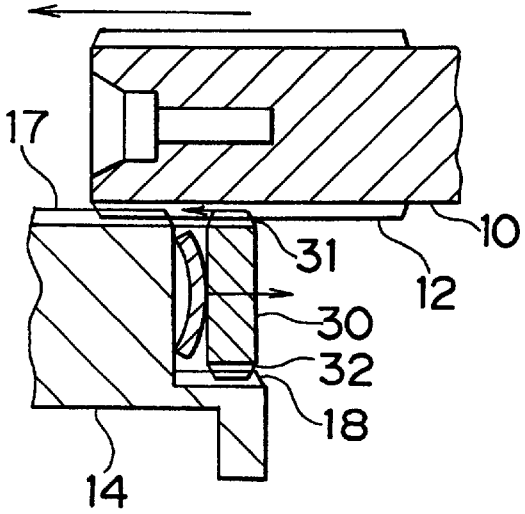
FIGS. 5A and 5B are schematic diagrams indicating a mechanical relationship of a sub-gear.

When the camshaft 10 is slid toward the forward end side as shown in FIG. 5A (leftward in FIG. 5A), a thrust force toward the forward end is transmitted to the sub-gear 30 via the friction between the external splines 12 and the internal splines 31. Therefore, the force acting on the sub-gear 30 toward the side of the rearward end of the camshaft 10 (the resultant force of the force from the wave washer 33 and the thrust force transmitted to the sub-gear 30 via the friction between the splines 12 and 31) decreases by the amount of thrust force transmitted via the friction, so that the pressing loads of the splines 12, 17, 31 on one another also decrease.

Figure 5B:
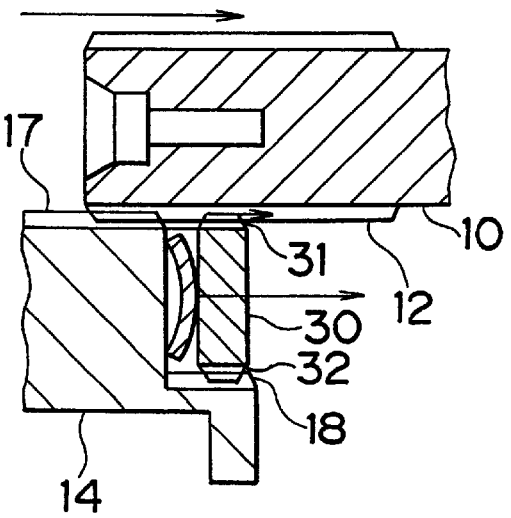

Conversely, when the camshaft 10 is slid toward the rearward end side as shown in FIG. 5B (rightward in FIG. 5B), a thrust force toward the rearward end side is transmitted to the sub-gear 30 via the friction between the splines 12 and 31. Therefore, the force acting on the sub-gear 30 toward the side of the rearward end of the camshaft 10 increases by the amount of thrust force transmitted via the friction, so that the pressing loads of the splines 12, 17, 31 on one another also increase.

That is, when the camshaft 10 is slid in the urging direction of the sub-gear 30, the sliding resistance increases and it becomes more difficult to secure a response speed of the camshaft 10, in comparison with a case where the camshaft 10 is slid in the direction opposite to the urging direction of the sub-gear 30.

An improved controllability of the cam displacement actuator 39 for displacing the camshaft 10 in the direction of the rotating axis can be secured by a setting wherein the operating direction of the cam displacement actuator 39 and the urging direction of the wave washer 33 are associated.

Figure 6:
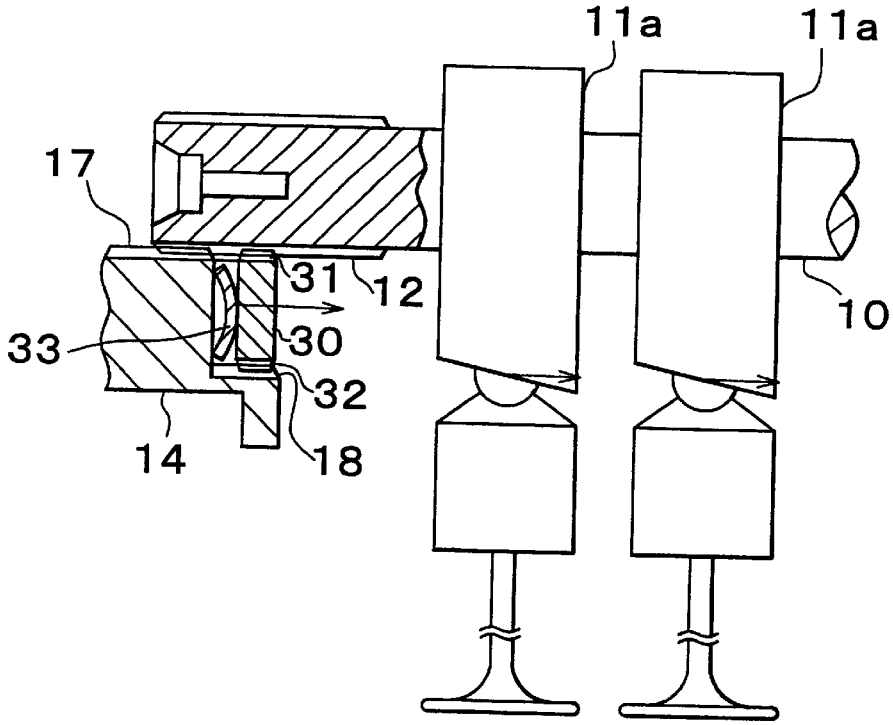
FIG. 6 is a schematic diagram showing an example of setting of a relationship between the urging direction of the sub-gear and the cam displacement direction according to a second embodiment of the invention.

For example, in a variable valve apparatus wherein a camshaft 10 having three-dimensional cams 11*a* whose lift height changes along the rotating axis is displaced in the direction of the rotating axis thereof as shown in FIG. 6, the camshaft 10 is urged toward a side where the valve lift achieved by the three-dimensional cams 11*a* becomes less (valve lift-decreasing displacement side), that is, rightward in FIG. 6, by force from valve springs of the engine valves when the three-dimensional cams 11*a* are in the valve lift phase. Therefore, when the camshaft 10 is displaced toward a valve lift-increasing displacement side where the valve lift achieved by the three-dimensional cams 11*a* becomes greater (leftward in FIG. 6), a greater thrust is needed and it becomes more difficult to secure a response speed than when the camshaft 10 is displaced toward the side where the valve lift becomes less (valve lift-decreasing displacement side). If the slope of the valve-lifting portion of each three-dimensional cam 11*a* is steeper, the thrust force caused by the pressing forces from the valve springs becomes greater and it becomes more difficult to secure a response speed for the displacement of the camshaft 10 toward the valve lift-increasing displacement side.

Therefore, in this embodiment, the side of greater valve lift achieved by the three-dimensional cams 11*a* of the camshaft 10 is set to a side in such a direction that the increase in the sliding resistance caused by the sub-gear 30 during the cam displacement is reduced, that is, to a side in a direction opposite to the urging direction of the wave washer 33, as shown in FIG. 6.

In this case, with regard to the displacement of the camshaft 10 toward the valve lift-increasing displacement side (displacement toward the left in FIG. 6), which opposes the thrust force based on the pressing forces from the valve springs, the sliding resistance caused by the sub-gear 30 during the cam displacement decreases. With regard to the displacement of the camshaft 10 toward the valve lift-decreasing displacement side (displacement toward the right in FIG. 6), which is assisted by the thrust force based on the pressing forces from the valve springs, the sliding resistance caused by the sub-gear 30 increases.

As a result, the difference between the response speed for the displacement of the camshaft 10 toward the valve lift-increasing displacement side and the response speed for the displacement thereof to the valve lift-decreasing displacement side decreases, so that the controllability of the cam displacement actuator 39 can be improved.

The above-described setting is not restrictive. For example, a setting as described below is also possible.

Figure 7:
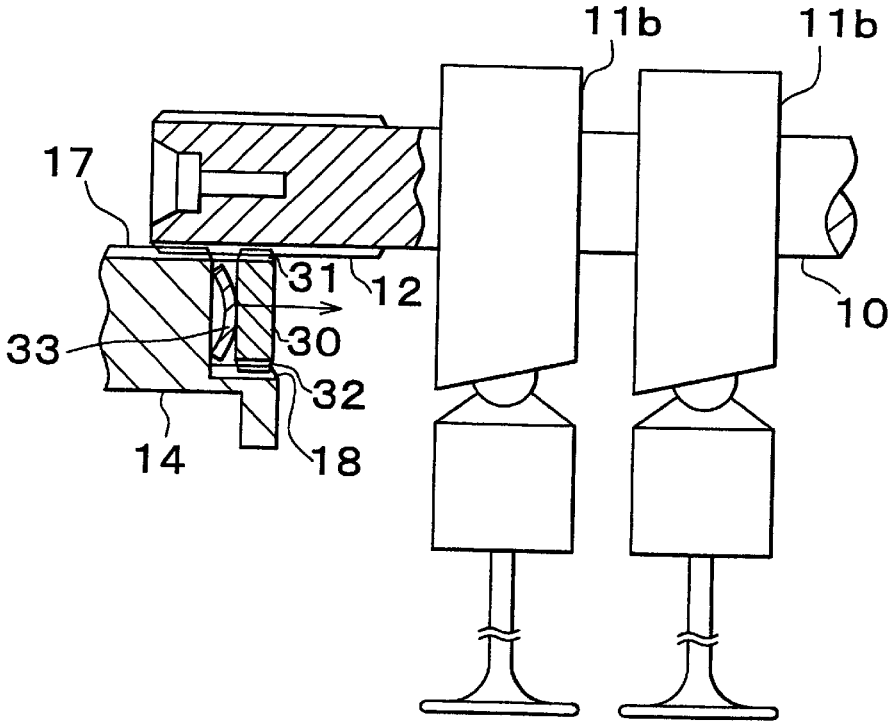
FIG. 7 is a schematic diagram showing another example of setting of a relationship between the urging direction of the sub-gear and the cam displacement direction.

In a variable valve apparatus having three-dimensional cams whose lift height changes along the rotating axis as described above, it is necessary to move the camshaft 10 toward the valve lift-decreasing displacement side, for example, at the time of a stop of the engine, a failure, or the like. If, as in these cases, a good response speed for the displacement toward the valve lift-decreasing displacement side is required, the required response speed can easily be secured by mounting three-dimensional cams 11*b* so that the valve lift-decreasing displacement side is set to a side in a direction opposite to the urging direction of the wave washer 33 as shown in FIG. 7. This is because the sliding resistance caused by the sub-gear 30 is less during cam displacements in the direction opposite to the urging direction of the wave washer 33 as described above.

Thus, with regard to the cam displacement actuator 39, necessary response speeds for cam displacements can easily be secured by a setting wherein the operating direction of a higher degree of requirement in the response speed becomes opposite to the urging direction of the impact noise preventing sub-gear 30. Therefore, the controllability of the cam displacement actuator 39 improves.

As is apparent from the above description, the internal combustion engine variable valve apparatus of this embodiment achieves advantages stated below, in addition to the advantages of the first embodiment.

In this embodiment, a setting is made such that one of the operating directions of the cam displacement actuator 39 in which the degree of requirement in the response speed is higher becomes opposite to the urging direction of the impact noise preventing sub-gear 30. Therefore, a necessary response speed can be more easily secured. Furthermore, good controllability of the cam displacement actuator 39 can be secured in a more preferable fashion.

(Third Embodiment)

A third embodiment that embodies the variable valve apparatus of an internal combustion engine of the invention will be described mainly with regard to features that distinguish the third embodiment from to the first and second embodiments.

Connecting the camshaft 10 into the slide hole 15 formed in the journal 14 via spline coupling enables integral rotation of the journal 14 and the camshaft 10, and allows the camshaft 10 to be displaced in the direction of the rotating axis of the camshaft 10 as described above.

There are cases where during a warm-up operation of the engine, the rotating axis of the journal 14 and the camshaft 10 wobbles or tilts due to chain tensions acting on the cam sprocket 13, pressing loads from the valve springs on the three-dimensional cams 11, or the like.

As a result, inappropriate loads may act on external and internal splines 12, 17. Thus, there is a danger of drawbacks, such as deterioration of the durability of the splines 12, 17, increases in the sliding resistance occurring during cam displacements, and the like.

In order to substantially prevent an inappropriate load from acting on the spline-coupled portions, a variable valve apparatus of this embodiment has a construction in which further stable support of the camshaft 10 is accomplished by providing the slide hole 15 of the journal 14 with a support portion for supporting a forward end portion of the camshaft 10.

Figure 8:
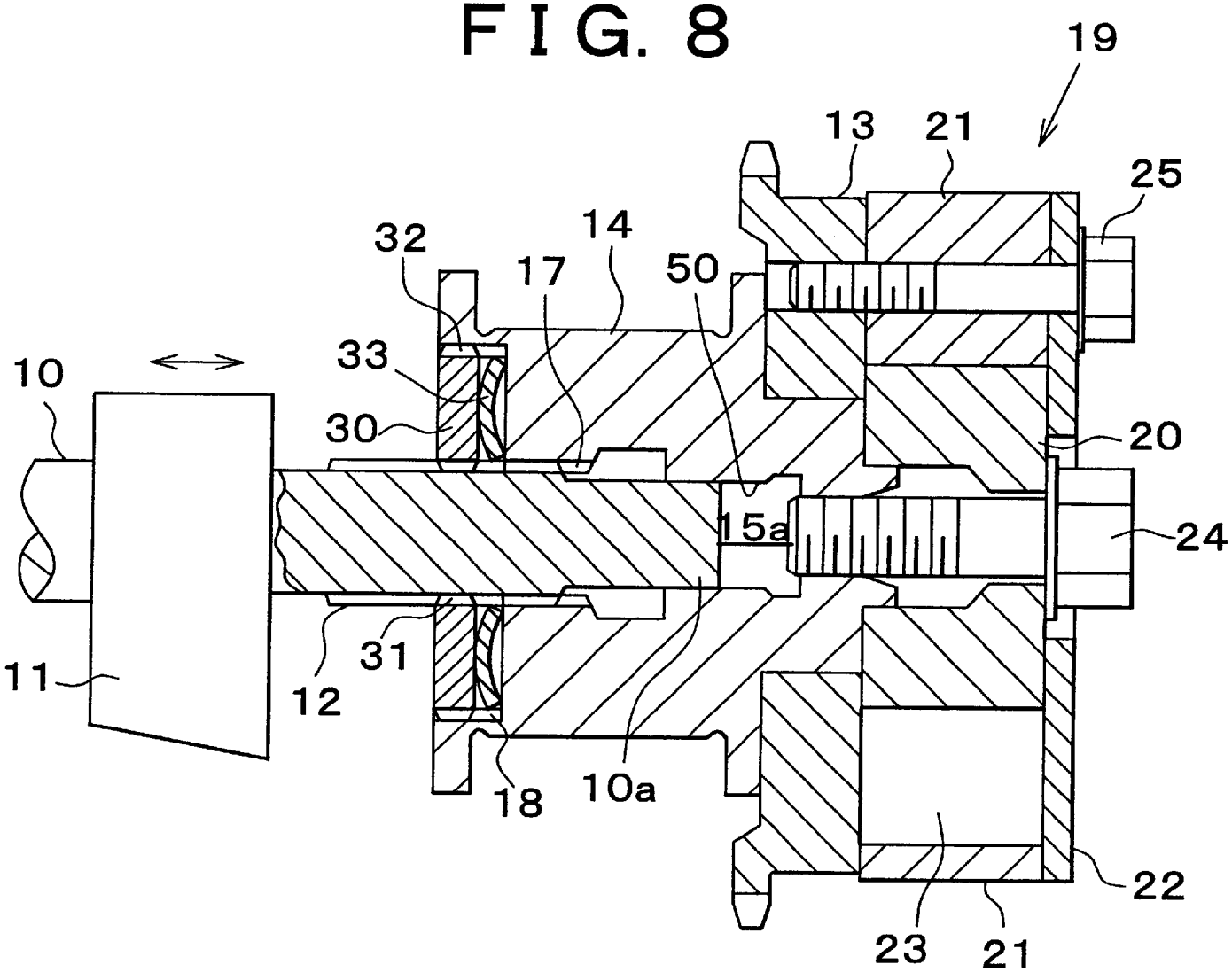
FIG. 8 is a sectional view showing a sectional construction of a phase variation actuator in a third embodiment of the invention.
Figure 9:
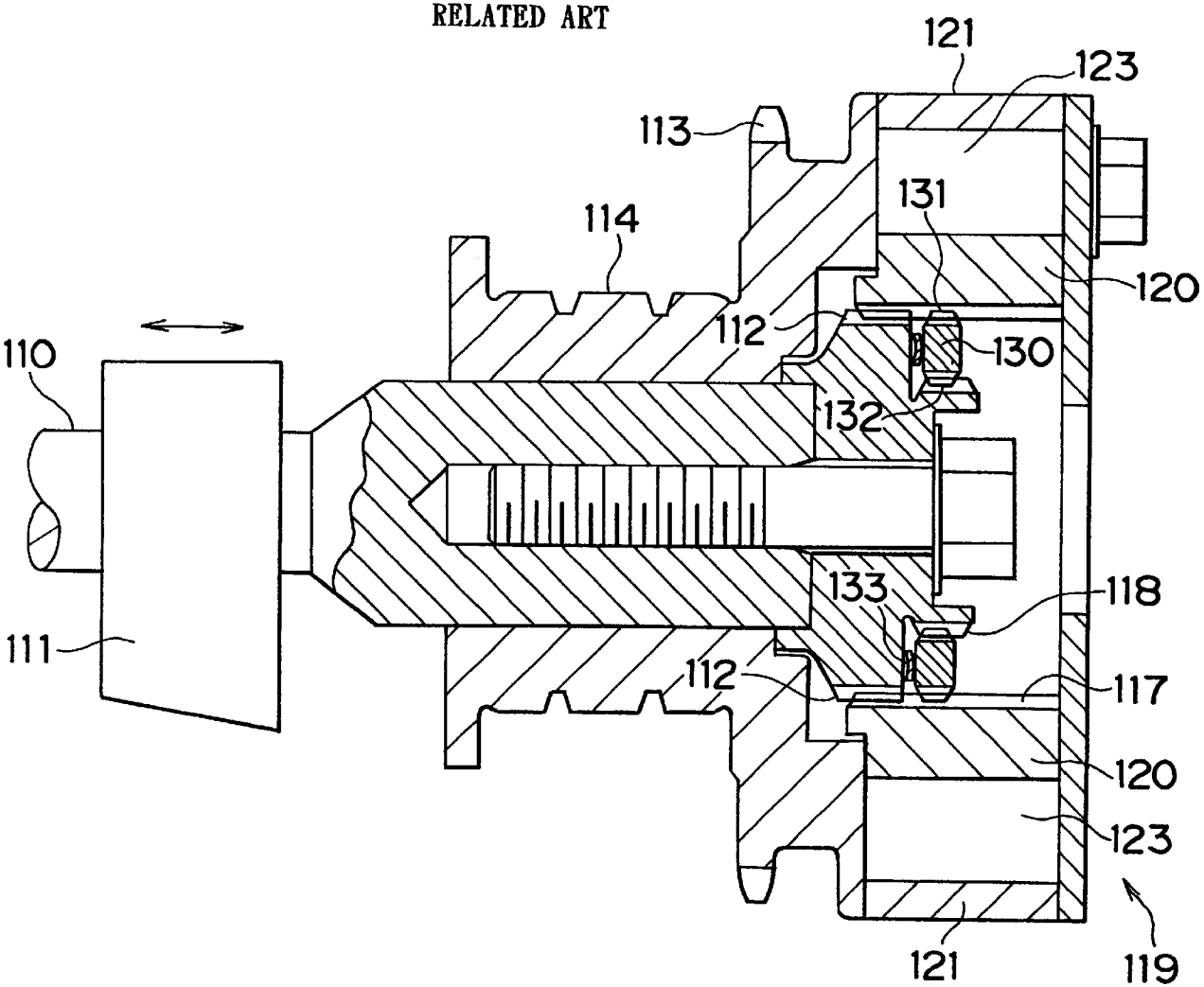
FIG. 9 RELATED ART
FIG. 9 is a sectional view showing a sectional construction of a conventional phase variation actuator.

FIG. 8 shows a side sectional construction of a phase variation actuator 19*a* of this embodiment.

As shown in FIG. 8, the camshaft 10 extends farther forward of the external splines 12. An extended forward end portion 10*a* of the camshaft 10 is supported by a support portion 50 that is formed at a forward end side of a slide hole 15*a* of a journal 14.

By thus supporting the camshaft 10 at the forward end portion 10*a* thereof extending forward of the external splines 12, the spline-coupled portions of the splines 12, 17 are supported at both sides thereof. Therefore, the provision of the support portion 50 effectively prevents wobble of the rotating axis of the journal 14 and the camshaft 10 in or around the spline-coupled portions that would otherwise be caused by pressing forces from the valve springs to the three-dimensional cams 11 during an operation of the engine.

Furthermore, since the support portion 50 is provided in a forward end portion of the journal 14, the journal 14 is supported at its forward and rearward end sides by the support portion 50 and the spline coupling. Therefore, the journal 14 can be supported, and the rotating axis of the journal 14 can be prevented from tilting despite chain tensions acting on the cam sprocket 13.

As is apparent from the above-description, the internal combustion engine variable valve apparatus of this embodiment achieves advantages as stated below, in addition to the advantages of the first embodiment.

In this embodiment, the support portion 50 for supporting the camshaft 10 is provided in the slide hole 15*a* of the journal 14. Therefore, the rotating axis of the camshaft 10 and the journal 14 is substantially prevented from wobbling and tilting, and improper loads acting on the external and internal splines 12, 17 are reduced. Hence, deterioration of the durability of the spline teeth and increases in the friction resistance occurring during cam displacements can be favorably curbed.

Furthermore, in this embodiment, the support portion 50 is provided at one end side (forward end side) of the slide hole 15*a* of the journal 14 in the direction of the rotating axis, and the internal splines 17 are provided at the other end side (rearward end side). By thus supporting the camshaft 10 at both end portions of the journal 14, the rotating axis of the journal 14 is prevented from wobbling or tilting. Therefore, the camshaft and the journal can be stably connected, so that deterioration of the durability of the camshaft and the journal and increases in the friction resistance occurring during cam displacements can be more effectively curbed.

Furthermore, in this embodiment, the support portion 50 is provided so as to support a portion (forward end portion 10*a*) of the camshaft 10 forward of the external splines 12. Therefore, the spline-coupled portion of the external and internal splines 12, 17 is supported at its both sides, so that wobble and tilt of the rotating axis of the camshaft 10 and the journal 14 can be more effectively controlled. As a result, deterioration of the durability of the spline teeth and increases in the friction resistance occurring during cam displacements can be more effectively curbed.

The internal combustion engine variable valve apparatus of the foregoing embodiments may be modified, for example, in the following manners.

In the third embodiment, the slide hole 15*a* has the internal splines 17 at the rearward end side of the journal 14, and has, at the forward end side, the support portion 50 for supporting the portion 10a of the camshaft 10 forward of the external splines 12. However, it is also possible to provide internal splines 17 at the forward end side of the journal 14 and provide the support portion 50 at the rearward end side of the journal 14. In this construction, the journal 14 is also supported at both end sides by the camshaft 10, so that the rotating axis of the journal 14 and the camshaft 10 can be substantially prevented from wobbling and tilting.

Furthermore, in the embodiment, the portion 10*a* of the camshaft 10 located forward of the external splines 12 is supported by the support portion 50 provided in a portion of the slide hole 15*a* located at the forward end side of the journal 14. However, even in a construction in which the support portion 50 is provided in, for example, a central portion of the journal 14, a support portion 50 may also be provided so as to support the portion 10*a* of the camshaft 10 forward of the external splines 12. In this case, too, the spline-coupled portion is supported at both sides, so that wobble and tilt of the rotating axis of the camshaft 10 and the journal 14 can be controlled.

Still further, as long as the slide hole 15*a* is provided with the support portion 50 for supporting the camshaft 10, inappropriate loads on the coupled portions of the external and internal splines 12, 17 can be reduced to some extent.

The supporting construction for the journal 14 and the camshaft 10 employing the support portion 50 may also be applied to a variable valve apparatus that does not have a spline impact noise preventing construction that employs a sub-gear as described above or the like. Furthermore, even in a variable valve apparatus that does not have an impact noise preventing construction, the connection of the camshaft 10 via the journal 14 still makes it possible to avoid an increase in the diameter of the phase variation actuator 19.

Although in the second embodiment, a setting based on an association between the operating directions of the cam displacement actuator and the urging direction of the impact noise-preventing sub-gear is made in conjunction with the three-dimensional cams whose lift height changes along the rotating axis, it is also possible to make a similar setting in conjunction with three-dimensional cams having other configurations. As long as a setting is made such that one of the operating directions of the cam displacement actuator in which the degree of requirement in the speed of response to a cam displacement becomes opposite to the urging direction of the sub-gear, a necessary response speed can be easily secured, and the controllability of the cam displacement actuator can be improved.

Furthermore, although in the second embodiment, the cam mounting direction is set in accordance with the urging direction of the sub-gear, substantially the same advantages can be achieved if the urging direction of the sub-gear is set in accordance with the cam mounting direction.

In the foregoing embodiments, the sub-gear 30 and the camshaft 10 are connected by the straight splines 12, 31, whose tooth trace extends in the direction of the rotating axis, and the sub-gear 30 and the journal 14 are connected by the helical splines 17, 32, whose tooth trace extends in a direction oblique to the direction of the rotating axis. However, as long as the tooth traces of the two spline couplings are different in the direction of extension or the tilt angle, an urging force on the sub-gear 30 in the direction of the rotating axis will urge the camshaft 10 and the journal 14 in such directions that they are turned relative to each other, and therefore production of impact noises caused by backlashes of splines can be controlled.

Furthermore, although the foregoing embodiments each employ the wave washer 33 as an urging member for urging the impact noise-preventing sub-gear 30, the urging member may be changed to any other suitable member, for example, an elastic member such as a rubber member or the like, as long as the member is capable of urging the sub-gear 30 in the direction of the rotating axis.

Furthermore, in the foregoing embodiments, the construction of the cam displacement actuator 39 is arbitrary. For example, it may be an actuator of an electrical drive type or the like, as long as the actuator is capable of sliding the camshaft 10 in the direction of the rotating axis.

Still further, the construction of the phase variation actuator 19 is also arbitrary. For example, the actuator 19 may be changed to a helical gear-type phase variation actuator, an actuator of a type other than a hydraulic drive type, or the like. In the case of a vane-type phase variation actuator as described in conjunction with the foregoing embodiments, the diameter of the actuator tends to increase due to the need to provide sufficiently large-capacity liquid chambers. In this case, therefore, the merits of avoiding a diameter increase by connecting the camshaft to a journal provided outside the actuator are significant. However, other types of phase variation actuators will also have problems of an increased diameter or an increased weight if a camshaft connecting construction that allows the camshaft to be slid in the direction of the rotating axis is provided inside the actuators. Therefore, even in the cases of other types of phase variation actuators, the connection of the camshaft to the journal provided outside the actuator will substantially avoid an increase in the diameter of the actuator.

While the present invention has been described with reference to preferred embodiments thereof, it is to be understood that the present invention is not limited to the disclosed embodiments or constructions. On the contrary, the present invention is intended to cover various modifications and equivalent arrangements. In addition, while the various elements of the disclosed invention are shown in various combinations and configurations, which are exemplary, other combinations and configurations, including more, less or only a single element, are also within the spirit and scope of the present invention.

What is claimed is:

1. A system including a variable valve apparatus and an internal combustion engine, the variable valve apparatus comprising:

a first rotating body connected to a drive-transmission wheel that transmits rotation of an output shaft of the internal combustion engine, in such a manner that the first rotating body is rotatable together with the drive-transmission wheel;

a second rotating body, the first rotating body and the second rotating body having a common rotating axis, the second rotating body and the first rotating body being rotatable relative to each other about the common rotating axis;

a phase variation actuator that rotates the first rotating body and the second rotating body relative to each other;

a journal provided adjacent to the phase variation actuator, and connected to the second rotating body so that the journal is rotatable together with the second rotating body, and the journal being rotatably supported by the internal combustion engine;

a slide hole portion provided in the journal, the slide portion receives therein a camshaft of the internal combustion engine so that the camshaft is slidable in a direction of a rotating axis of the camshaft;

an internal spline formed in an inner periphery of the slide hole portion and extending in the direction of the rotating axis of the camshaft; and an external spline formed in an outer periphery of the camshaft and meshing with the internal spline.

2. A system according to claim 1, wherein an outer one of the first and second rotating bodies is disposed radially outwardly of an inner one of the first and second rotating bodies, and a space defined in a slide-contact portion located between the first rotating body and the second rotating body is divided into two liquid chambers by a vane which is formed in the inner one of the first and second rotating bodies, and which extends in a direction of a radius of the rotating bodies, and wherein based on an adjustment of a liquid pressure in the liquid chambers, the phase variation actuator turns the first rotating body and the second rotating body relative to each other.

3. A system according to claim 1, wherein the journal is separated from the phase variation actuator.

4. A system according to claim 1, further comprising a cam displacement actuator that displaces the camshaft in the direction of the rotating axis of the camshaft.

5. A system according to claim 1, wherein the camshaft is provided with a three-dimensional cam whose cam profile changes in the direction of the rotating axis of the camshaft.

6. A system according to claim 1, further comprising:

a sub-gear for preventing production of a noise caused by an impact of the external spline and the internal spline; and an urging member disposed within the journal and which urges the sub-gear in the direction of the rotating axis.

7. A system according to claim 6, further comprising a cam displacement actuator that displaces the camshaft in the direction of the rotating axis of the camshaft.

8. A system according to claim 7, wherein an operating direction of the cam displacement actuator that requires a highest response speed is set opposite to an urging direction of the urging member.

9. A system according to claim 8, wherein:

the camshaft is provided with a three-dimensional cam whose cam profile changes in the direction of the rotating axis of the camshaft; and a valve lift-increasing displacement side of the three-dimensional cam is set to a side in a direction opposite to the urging direction of the urging member.

10. A system according to claim 8, wherein:

the camshaft is provided with a three-dimensional cam whose cam profile changes in the direction of the rotating axis of the camshaft; and a valve lift-decreasing displacement side of the three-dimensional cam is set to a side in a direction opposite to the urging direction of the urging member.

11. A system according to claim 1, wherein the slide hole portion of the journal has a support portion that supports the camshaft.

12. A system according to claim 11, wherein the support portion is provided on an end side of the slide hole portion of the journal in the direction of the rotating axis, and the internal spline is provided on another end side of the slide hole portion in the direction of the rotating axis.

13. A system according to claim 12, wherein the support portion is provided so as to support a portion of the camshaft that is located at a distal end side of the external spline of the camshaft.

14. A system according to claim 1, wherein the journal is located adjacent to the phase variation actuator in the direction of the common rotating axis of the first and second rotating bodies.

15. A variable valve apparatus for use with an internal combustion engine, the variable valve apparatus comprising:

a first rotating body;

a second rotating body, the first and second rotating bodies having a common rotating axis, the second rotating body and the first rotating body are rotatable relative to each other about the common rotating axis;

a phase variation actuator that rotates the first rotating body and the second rotating body relative to each other;

a journal provided adjacent to the phase variation actuator, and connected to the second rotating body so that the journal is rotatable together with the second rotating body;

a slide hole portion provided in the journal for slidably receiving therein a camshaft of the internal combustion engine so that the camshaft is slidable in a direction of a rotating axis of the camshaft;

an internal spline formed in an inner periphery of the slide hole portion and extending in the direction of the common rotating axis; and an external spline formed in an outer periphery of the camshaft and meshing with the internal spline.

16. A variable valve apparatus according to claim 15, wherein an outer one of the first and second rotating bodies is disposed radially outwardly of an inner one of the first and second rotating bodies, and a space defined in a slide-contact portion located between the first and second rotating bodies is divided into two liquid chambers by a vane which is formed in the inner one of the first and second rotating bodies, and which extends in a direction of a radius of the rotating bodies, and wherein based on an adjustment of a liquid pressure in the liquid chambers, the phase variation actuator turns the first rotating body and the second rotating body relative to each other.

17. A variable valve apparatus according to claim 15, wherein the journal is separated from the phase variation actuator in the direction of the common rotating axis.

18. A variable valve apparatus according to claim 15, further comprising:

a sub-gear for preventing production of a noise caused by an impact of the internal spline and a spline of the camshaft; and an urging member which is disposed within the journal and which urges the sub-gear in the direction of the rotating axis.

* * * * *